US005143251A

United States Patent [19]

Kahanek et al.

[11] Patent Number: 5,143,251

[45] Date of Patent: Sep. 1, 1992

[54] SINGLE VEND DEVICE FOR A NEWSPAPER VENDING MACHINE

[75] Inventors: Allen P. Kahanek, Yoakum; Ralph J. Ullman, Shiner, both of Tex.

[73] Assignee: Kaspar Wire Works, Inc., Shiner, Tex.

[21] Appl. No.: 775,616

[22] Filed: Oct. 15, 1991

[51] Int. Cl.[5] ..... B65H 3/00

[52] U.S. Cl. ..... 221/152; 221/155; 221/207; 221/226; 221/241; 221/279

[58] Field of Search ..... 221/151, 152, 154, 155, 221/191, 192, 206, 207, 226, 241, 279

[56] References Cited

U.S. PATENT DOCUMENTS

| | | | |
|---|---|---|---|
| 3,747,733 | 7/1973 | Knickerbocker | 221/155 X |
| 4,067,477 | 1/1978 | Chalabian | 221/155 X |
| 4,981,236 | 1/1991 | Riedle et al. | 221/152 X |

*Primary Examiner*—David H. Bollinger

*Attorney, Agent, or Firm*—Gunn, Lee & Miller

[57] ABSTRACT

The application discloses a device (10) to retrofit into the cabinet (11) of newspaper vending machine racks to prevent the removal of more than one copy of the newspaper for each vend or door opening of the cabinet (11). The single vend device (10) consists of a front panel (12) with a T-slot (14). The arms (14*a*) of the T-slot (14) are normally closed off with a pivoted closure plate (16). Consumer access to the newspapers is provided through the leg of the T-slot (14*b*), but the newspaper must be slid through the gap between the closure plate (16) and the front panel (12). The thickness of the gap is adjustable to selectively allow for the variation in thickness between various editions of the newspaper. The closure plate (16) is spring loaded to be biased to the closed position. Following removal of the paper, the closure of the plate (16) and a locking pin (32) prevents the plate (16) from re-opening. The locking pin (32) is disarmed upon closure of the cabinet (11) door (25*a*).

1 Claim, 5 Drawing Sheets

SINGLE VEND DEVICE FOR A NEWSPAPER VENDING MACHINE

FIELD OF THE INVENTION

This invention relates to an anti-theft device for newspaper vending machines, more particularly to an anti-theft device comprised of a front panel with a T-shaped slot, access through which is controlled by a closure plate. The degree to which the plate open is adjustably varied, selectively allowing thicker or thinner editions of a newspaper to pass therethrough.

BACKGROUND

Newspaper vending machines are an increasingly popular way of distributing newspapers throughout the country. Frequently, newspaper vending machines act on a honor system. That is, a consumer will insert the required amount of coinage into the coin mechanism of the newspaper vending machine which will then allow the consumer access to the newspaper containing cabinet of the vending machine through a manually-operated door. The door, being unlocked upon the insertion of the required amount of coinage, usually allows the consumer access to all of the newspapers. The dishonest consumer will take more than one edition of the newspaper. This is especially true when newspapers, especially those in highly competitive metropolitan markets, offer "game cards" with each edition. The dishonest consumer will take all of the editions, or in many cases, more than one edition in order to gain access to the game cards and increase his chances of winning a prize.

Thus, what is needed in the industry is a simple device to deter the theft of more than one newspaper that is capable of being retrofitted into the cabinets of existing newspaper vending machines.

Applicant's device solves such a need by providing a device to retrofit into the cabinets of newspaper vending machine racks to prevent the removal of more than one copy of the newspaper for each vend or door opening of the cabinet. The single vend device consists of a front panel with a T- or Y-shaped slot. The arms of the slot are normally closed off with a pivoted closure plate. Consumer access to the newspapers is provided through the leg of the slot, but the newspaper must be slid horizontally through the gap between the closure plate and the front panel. The thickness of the gap is adjustable to selectively allow for the variation in thickness between various editions of the newspaper. The closure plate is spring loaded to be biased to the closed position. Following removal of the paper and the closure of the plate and a locking pin prevents the plate from pivoting. The locking pin is disarmed upon closure of the cabinet door.

Thus it is the purpose of this invention to provide for a single vend device for easily (without tools) retrofitting newspaper vending machines that will help deter the theft of more than one issue of the newspaper by providing an adjustable width closure plate and an access slot, with resetable means for locking the normally biased closure plate in a locked position following the removal of single edition through the access slot.

SUMMARY OF THE INVENTION

This invention provides an anti-theft device for newspaper vending machines having a cabinet for substantially enclosing newspapers, an elevator shelf onto which the newspapers are stacked, which elevator shelf raises as newspapers are removed from the top of the stack, a manually-operated, hingedly-attached door to provide access to the interior of the cabinet, a means to lockingly engage the door and a coin-control mechanism to engage and disengage a locking means. More specifically, the anti-theft device of the present invention comprises a front panel with a front and a rear surface, for substantially blocking access to the newspaper stack, the front panel having a perimeter thereon dimensioned to removably engage the cabinet of the newspaper vending machine, the front panel with walls defining a "T-shaped" opening, the arms of the opening being of sufficient width to extract a newspaper widthwise therefrom, the leg of the opening being substantially less than the width of a newspaper; key operative locking means engageable with the perimeter of said front panel to lock said front plate to the walls of the cabinet; a mounting panel with a top and a bottom surface integral with said front panel located above the T-shaped opening of said front plate, said mounting base projecting substantially perpendicular from the rear surface of said front panel; a closure plate pivotally mounted to the rear surface of said front plate above the T-shaped opening and below said mounting base, the closure plate dimensioned to substantially cover the arms of the T-shaped opening, the closure plate having a flat portion and a bent portion, said closure plate with a leading edge defining the edge between the two portions, said closure plate for moving between a closed position, the closed position with the leading edge flush against the lower edge of the rear surface of the walls defining the arms of the T-shaped opening, the closed position substantially preventing access to the newspapers and an open position, said open position reached by rotation of said closure plate from the closed position until the leading edge of said closure plate is at a position removed from the walls defining the lower edge of the T-shaped opening, the open position defining an access width through which the newspaper is removed from the interior of the cabinet; a sheet slidably mounted to and flush with the bottom surface of said mounting base, the sheet operatively engaged with the rear surface of the closure plate such that movement of the closure plate towards an open position causes the sheet to slide away from said panel and across the bottom surface of said mounting base; means to adjust the access width, said means comprising walls defining a line of adjustment holes through said mounting plate, a pin dimensioned to engage the adjustment holes, and pin retainment means slidably mounted in alignment with the adjustment holes, the width adjustment means further comprising an edge of said slidably mounted plate, the edge in acute angular relationship to the line of adjustment holes; means biasing said closure plate towards the closed position; means to resetably lock the closure plate in the closed position, said closure plate lock means comprising an arm means, a pin means, and a reset means, the arm means coupled to the door of the newspaper cabinet, the arm means to raise the pin out of a hole in said sliding sheet, the hole aligned with said pin for receipt of the pin therethrough, when said closure plate is the first position, the pin released from its raised position by resent means upon movement of the closure plate from its first position, thereby allowing pin to re-engage the hole upon return of said plate to the first position.

DETAILED DESCRIPTION OF THE PREFERRED EMBODIMENT

Figure 1:
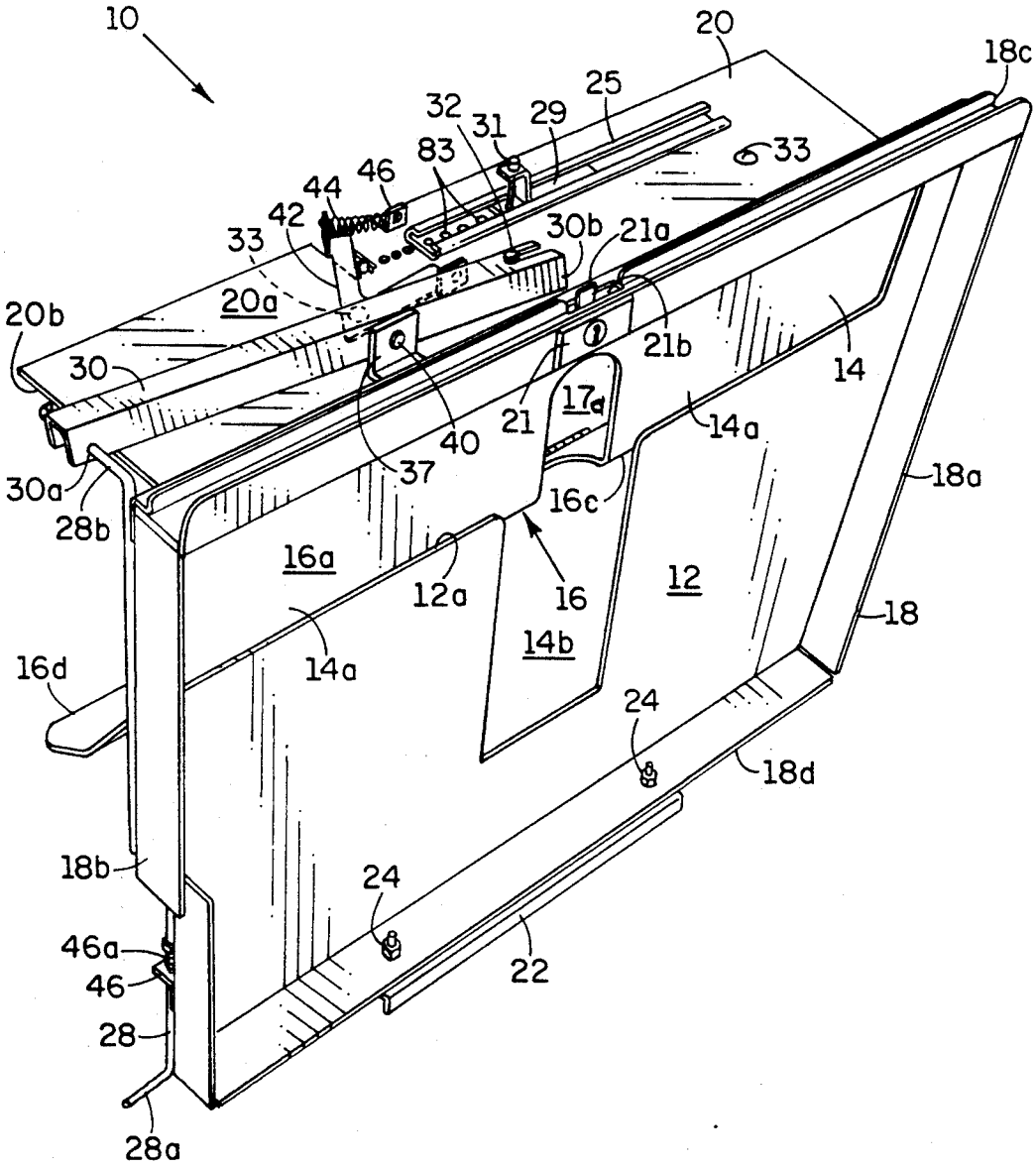
FIG. 1 is a prospective view showing the front of the theft deterrent device.
Figure 3:
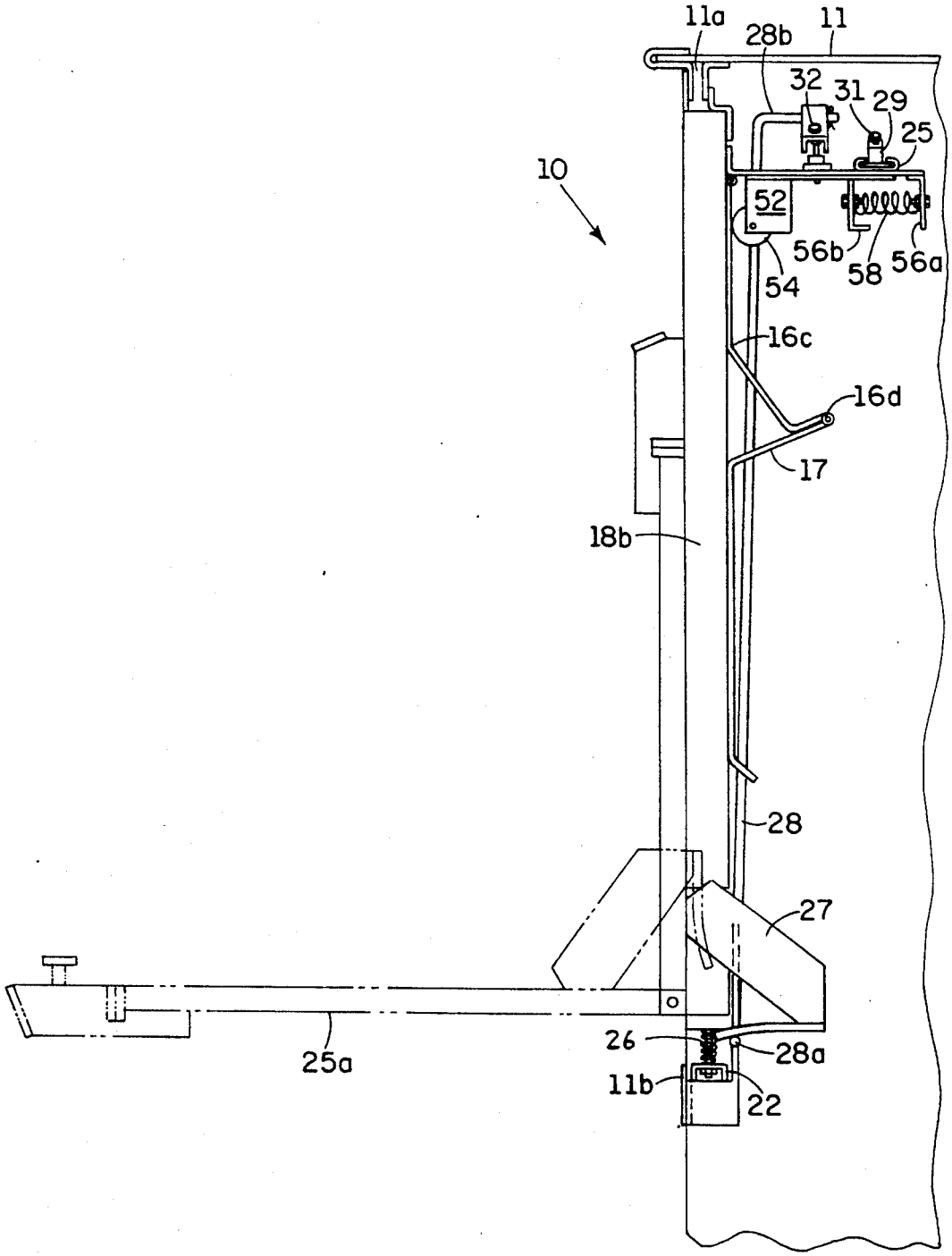
FIG. 3 is a side elevational view of the theft deterrent device.

With reference to FIGS. 1 and 3 it can seen that the theft determent device (single vend device) (10) of the present invention is adapted to fit into a cabinet (11) and comprises a front panel (12) with a T- or Y-shaped opening (14) therein (hereinafter, reference to T-shaped will be understood to mean Y-shaped also). As it is further evidenced from FIG. 1, the T-shaped slot is dimensioned with arms (14*a*) extending generally transverse to leg (14*b*). Front panel (12) has a top edge (12*a*) defining the lower border of arms (14*a*). Access through arms (14*a*) of T-shaped opening (also called "access slot") (14) is controlled by means of a pivotally mounted closure plate (16) having a front surface (16*a*) and a rear surface (16*b*). Closure plate (16) is generally "J" shaped and has leading edge (16*c*) and trailing edge (16*d*). Cut-out (17*a*) in closure plate (16), in conjunction reach the newspapers. The newspaper stack (not shown) generally rests on an elevated, upwardly biased shelf which will urge the stack upward toward trailing edge (16*d*) as papers are removed. As can be seen in FIG. 1, leading edge (16*c*) lies across and just below top edge (12*a*) of the front panel when closure plate (16) is in its normally biased, closed position as represented in FIG. 1. Tail (17) is pivotally mounted centrally along trailing edge (16*d*) to hang freely therefrom. This helps keep the papers in the stack from curling up.

Turning back to front panel (12), it may be seen that perimeter (18) is integral therewith. More particularly, perimeter (18) is comprised of right side (18*a*) and left side (18*b*), top edge (18*c*) and lower (18*d*). Further, from viewing FIGS. 1, 2, and 3, it can be appreciated that perimeter (18) is dimensioned to be received within the front opening of cabinet (11) of the newspaper vending machine. More particularly, FIG. 3 illustrates the manner in which lips (11*a*) and (11*b*) of cabinet (11) engage the groove defining top edge (18*c*) and channel (22) to retain single vend device (10) to cabinet (11).

Pausing for a moment, to discuss the function of the above be cited structure, it can be appreciated that front panel (12) substantially prevents access to newspapers within the cabinet of the newspaper rack when the panel is affixed thereto. More particularly, it can be appreciated that access to the newspapers is limited to the hand of the consumer reaching through leg (12*b*) to slide the paper on top of the stack "up and out" the access slot as the closure plate pivots away, producing a gap between top edge (12*a*) and leading edge (16*c*). With closure plate (16) biased in a normally closed position, the removal of the newspaper through arms (14*a*) of the slot will allow closure plate (16) to resume its normally closed position.

Examining now, the details of FIGS. 1 and 2, it can be seen that front panel (12) has attached to the rear surface thereof top or mounting plate (20) to which it is attached a myriad of various structures, the details of which will be examined below. Along lower edge (18*b*) is mounted channel (22) on attachment means (24) with springs (26) to bias channel (22) to a position removed from lower edge (18*d*). At top edge (18*c*) it can be seen that there is a similarly dimensioned channel. Also along top edge (18*c*) can be found key means (21) to lock theft determent device (10) into the cabinet of the newspaper vending machine. Blade (21*a*) is normally recessed into slot (21*b*) along top edge of perimeter (18*c*) for insertion and removal of single vend device (10) into cabinet (11). However, once means (21) operated, blade (21*a*) is pivoted from its recessed position to project vertically upward and behind lip (11*a*), single vend device (10) is locked into the cabinet (11). Key means (21) allows the anti-theft device (10) of the present invention to be locked within the cabinet of the newspaper vending machine by providing blade (21*a*) to rotatably and lockingly engage the upper lip of the cabinet interior.

Functionally, the devices described in the preceding paragraph will allow the anti-theft device to be lockingly inserted into upper and lower members of walls defining the interior of a standard sized newspaper vending machine cabinet. Such cabinets are well known in the art. An example of one such cabinet is the SHO-RACK® by Kaspar Wire Works, Inc. of Shiner, Texas, Assignee of the present invention. The anti-theft device (10) as disclosed here is, in fact, dimensionally and structurally suited for insertion into the SHO-RACK® models number K-80 and TK-80. Both of these models have &he elevator shelf rack that will provide for a stack of newspapers urged upwards so that the removal of the top edition will allow the stack to move upward so as to continue to provide a stack within reach through means (17) and (14*b*), but not above trailing edge (16*d*).

Having described now, the general features of front panel (12), T-shaped slot (14) and closure plate (16), we turn now to the varied structure that is located on or about top plate (20). References made to FIGS. 1 and 2 for the following discussion with FIGS. 3, 4, 5, and 6 more particularly describing subcomponents of the devices. As appreciated from the foregoing discussion, it is important that closure plate (16) be locked in the closed position as illustrated in FIG. 1 following the removal of the single edition of a newspaper through T-shaped opening (14). If not, the dishonest consumer could just continue to remove newspapers. Locking pin (32) in engagement with the following structure, achieves such a function. More particularly, actuator engagement arm (28) riding on guide (46) and biased upward by spring (46*a*) engages actuator member (27) of door (25*a*) of the newspaper rack at engagement finger (28*a*), each time door (25*a*) is closed. At the removed end of actuator engagement arm (28*b*) and pivoting thereon is pin engagement arm (30). Engagement arm (30) is bias by the influence of the spring (46*a*) to a normally "up" position. Pin engagement arm (30) is pivoted at pivot (40) located on "L-shaped" bracket (37) mounted to the top plate (20).

Pausing momentarily to discuss the function of the locking pin system, it can be seen that the opening and closing of door (25*a*) will raise and lower locking pin (32) through the action of actuator member (27) on arms (28) and (30).

Figure 2:
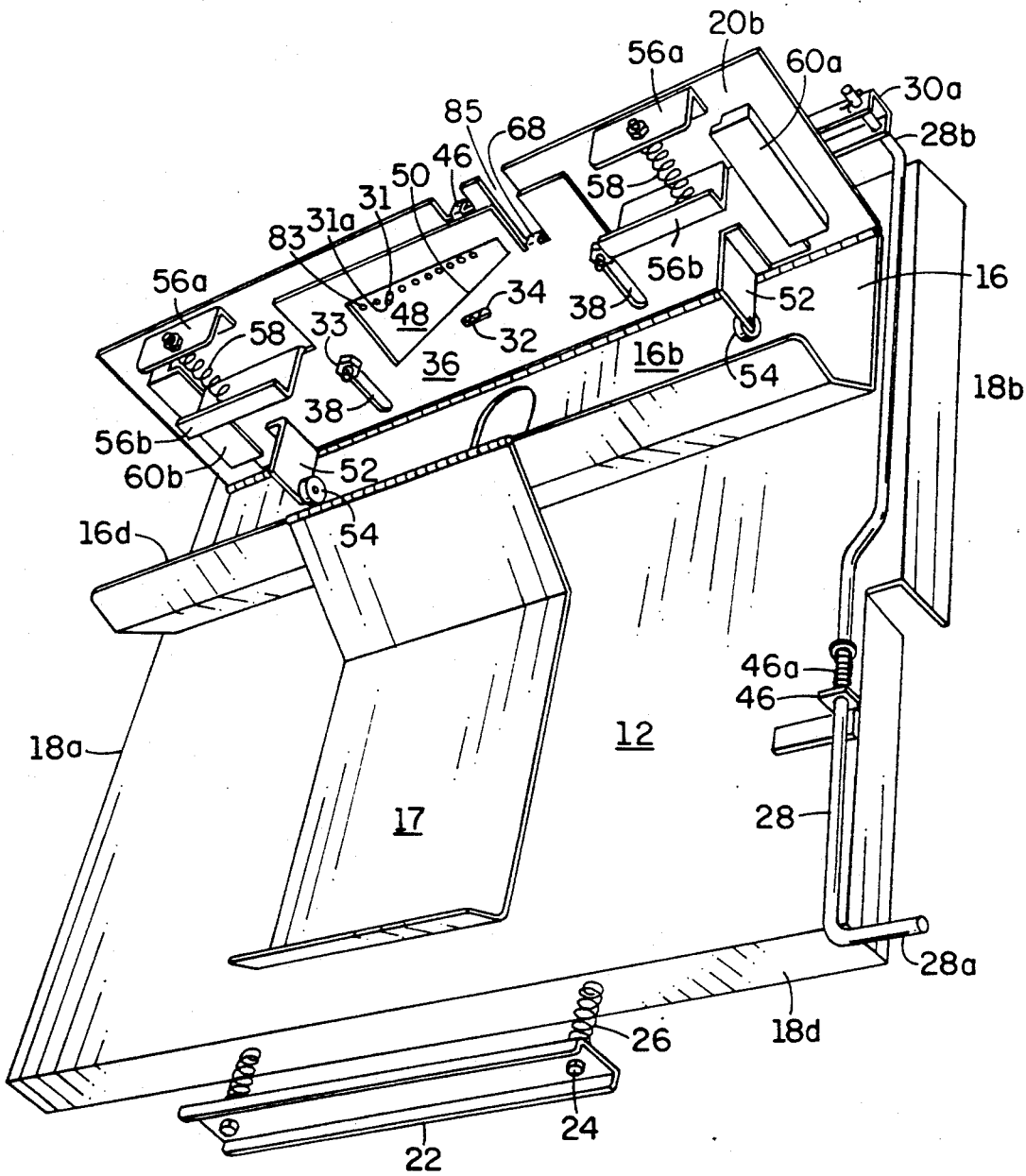
FIG. 2 is a prospective view showing the rear of the theft deterrent device.

Turning now to FIG. 2 it can be seen that bottom surface (20*b*) of top plate (20) contains a sliding plate flushly mounted and riding thereon. Sliding plate (36) contains many features which are discussed in more detail as follows. Attention is now turned to locking pin (32) which when viewed from the underside of the anti-theft device as illustrated in FIG. 2 can be seen to project through hole (34) in sliding plate (36). In the position as illustrated in FIG. 2 closure plate (16) is locked in the closed position. In this position, it can be appreciated that if locking pin (32) projects through hole (34), sliding plate (36) cannot slide rearward, as will be required to open closure plate (16) and allow access to the newspapers. It can also be appreciated that when engagement finger (28*a*) is pressed downward and attachment end (30*a*) of pin engagement arm (30) is lowered, slot end (30*b*) of pin engagement arm (30) will raise locking pin (32). In a raised position, locking pin (32) will allow sliding plate (36) to slide across bottom surface of (20*b*). Thus, the raising and lowering of locking pin (32) into and out of hole (34) of sliding plate (36) will control the ability of closure plate (16) to pivot to an open position.

Turning now to more detail of the unique sliding plate (36) it can be seen that sliding plate (36) rides along bottom surface (20*b*) on paired slotted guides (38) and bolts (32). This bolt and guide system acts in conjunction with lateral guide means (60*a*) and (60*b*) to prevent side-to-side movement and limit the movement of sliding plate (36) to the "fore-and-aft" or "front-and-back" motion along bottom side (20*b*) of top plate (20). Moreover, it can be seen that such for and aft movement of sliding plate (36) is initiated by the movement of closure plates (16) from its normally closed position. That is, sliding plate bias mounts (56*a*) and (56*b*) separated by spring bias (58) press against mounting plate (52) mounted rollers (54) and against rear surface (16*b*) of closure plate (16). It is this means, referenced earlier, that maintains closure plate (16) in a normally closed position. More particularly, it can be seen that sliding plate bias mounts (56*b*) are integral with the sliding plate and urge sliding plate (36) with its integral mount plates (52) and rollers (54) against the rear surface (16*b*) of closure plate (16).

At this point in our discussion of theft deterrent device (10) we have seen that there is a means to urge closure plate to a closed position and a means to lock and unlock closure plate (16) into such a closed position, such lock/unlock means engaged by the door opening of the newspaper cabinet. What is needed is a means to arm locking pin (32) and disarm locking pin (32). That is, a means to provide for the details of such means will be more appreciated with referenced to FIGS. 1, 2, 3, and 6.

On door closure, engagement finger (28*a*) is pressed downward raising locking pin (32) out of hole (34). Of course, as the door is being closed, the newspaper has already been removed and enclosure plate (16) is in a closed position with hole (34) aligned beneath locking pin (32).

Figure 6:
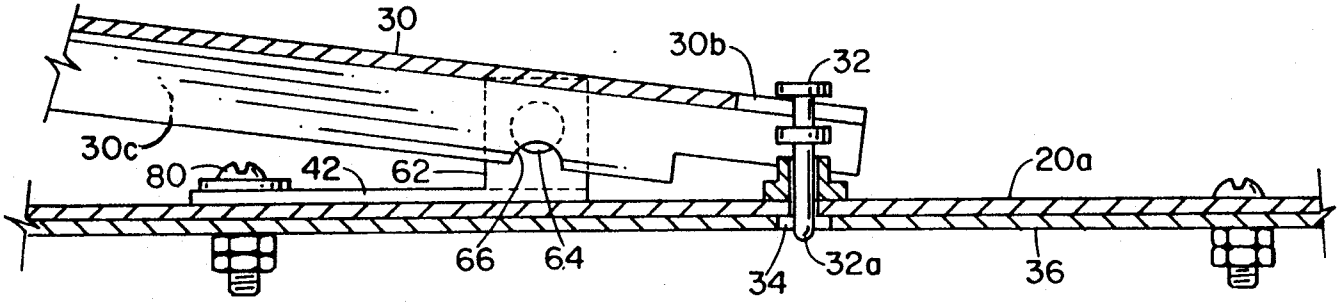
FIG. 6 is a side elevational view, and cutaway, of the resetable locking pin feature of the theft deterrent device removed from the remainder of the device.
Figure 4:
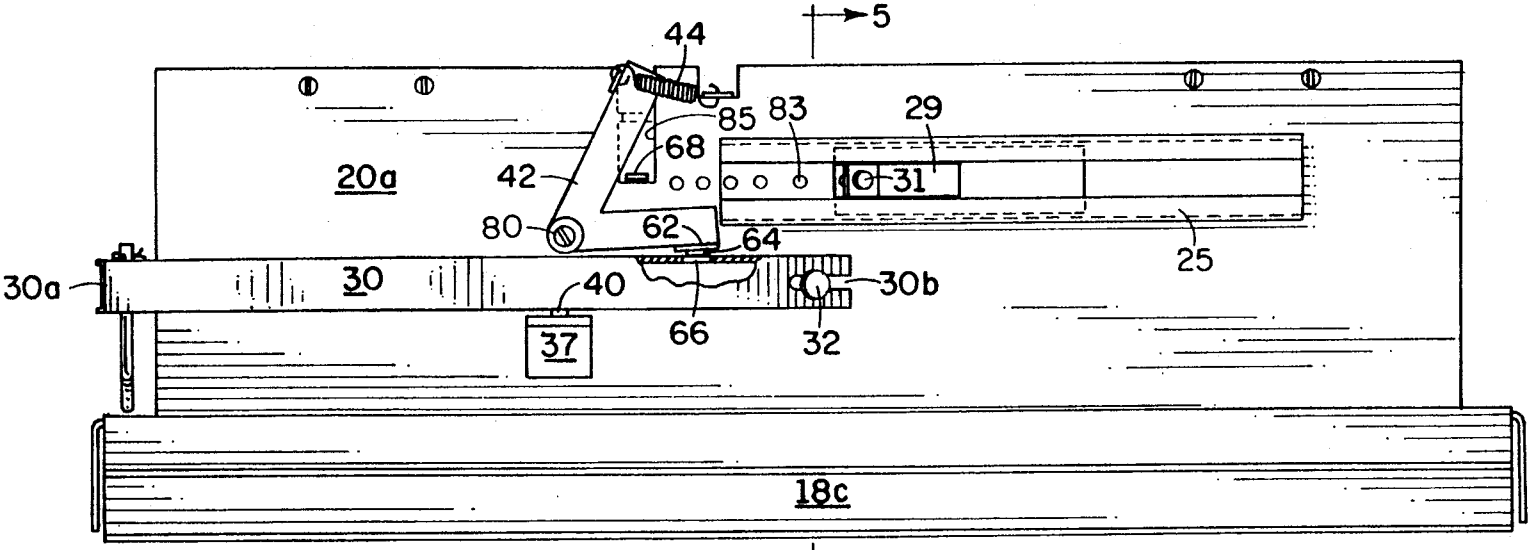
FIG. 4 is a top planiform view of the theft deterrent device
Figure 5:
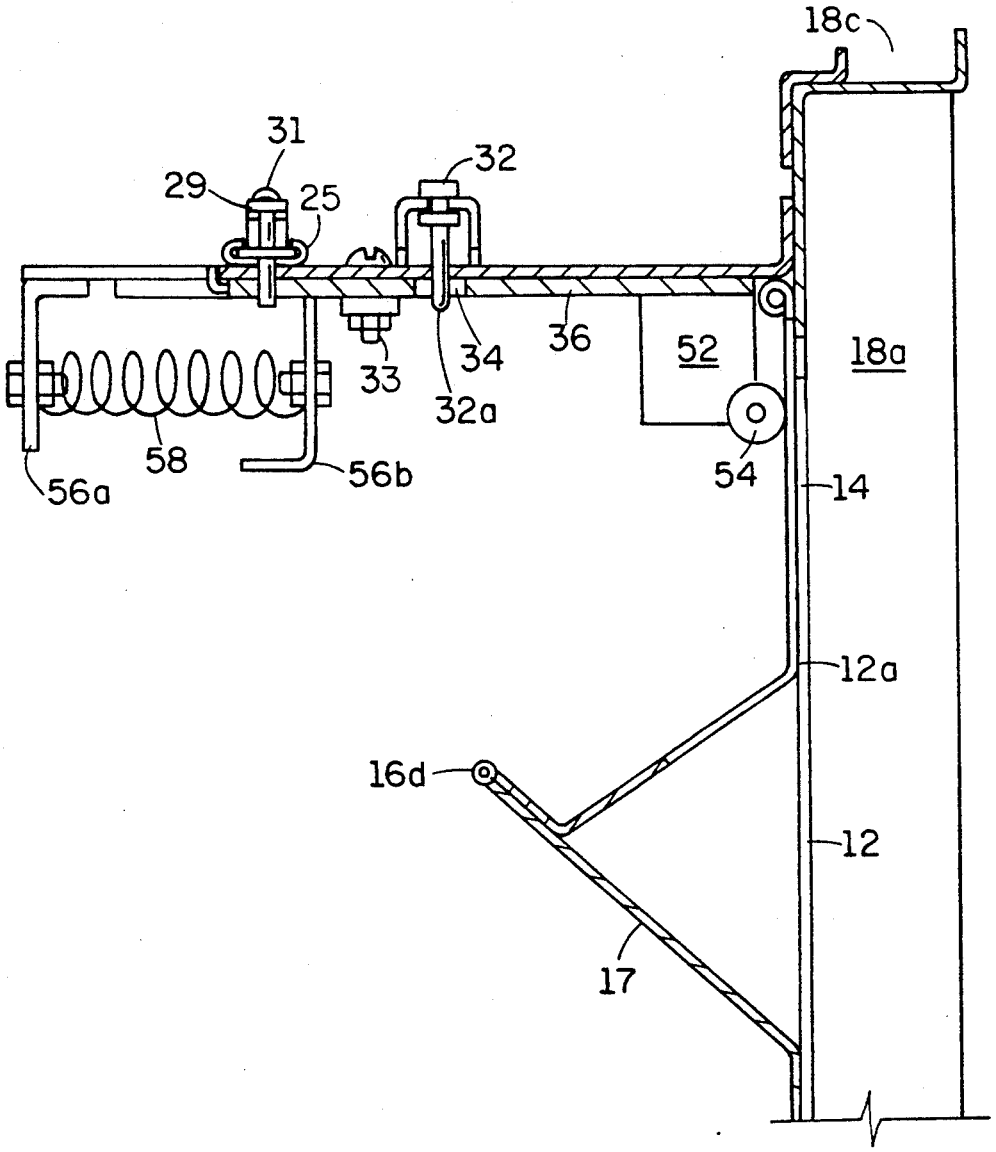
FIG. 5 is a side elevational view and cutaway of the upper portion of the theft deterrent device.

Perhaps reference to FIG. 4, 5 and 6 more closely illustrates the locking pin reset method. Reset arm (42) engages both sliding plate (36) at engagement finger (68) and pin engagement arm (30) at locking pin (64) located on mounting arm (62) of reset arm (42). This can be more particularly appreciated in FIG. 6, where reset locking lip (66) on engagement arm (30) is dimensioned to engage reset locking pin (64). Spring (44) biases reset arm (42) against wall (30*c*) of engagement arm (30). As slotted end (30*b*) of engagement arm (30) is raised, such as upon closing of the door of the newspaper vending machine, actuator engagement arm (28) moves downward and pin (32) will be lifted from hole (34). When pin engagement arm (30) is lifted high enough for the removed end (32*a*) of pin (32) to clear a hole (34), reset locking lip (66) will engage the upper perimeter of reset locking pin (64), thereby preventing slotted end (30*b*), normally bias downwardly, by spring (46*a*), from falling. Thus, this is the condition of theft deterrent device (10) when the next consumer opens the door. That is, the locking pin reset mechanism is in a "loaded condition," ready to reset the locking pin.

As the consumer begins to withdraw the paper through the closure plate the sliding action of rollers (54) move sliding plate (66) rearward, allowing engagement finger (68) to act on reset arm (42) (See FIG. 1). This action uncouples locking pin (64) from resetting locking lip (66) allowing normally biased pin engagement arm to shift downward at slotted end (30*b*). However, removed end (32*a*) of locking pin (32) will now be riding on the topside of sliding plate (36) as the closure plate opens and begins to close. However, following withdrawal of the newspaper, closure plate (16) moves to the normally biased closed position. Removed end (32*a*) of locking pin will then fall in hole (34) locking slotted plate (36) in place such that rollers (54) block opening of enclosure plate (16) until door (25*a*) of the vending machine is closed. Thus, it is seen how there are means to set and reset locking pin (32) thereby allowing access through T-shaped opening (14).

It remains to be seen, in the following section of the specifications, the manner in which the width of the opening created by pivoting the enclosure plate may be varied so as to be narrow for the thin daily editions of the newspapers but to be wider for the thicker editions, such as the Sunday editions of the newspaper. What is desired is a means to simply and quickly and adjustably provide for a variety of opening distances between top edge (12*a*) of front panel (12) and leading edge (16*c*) of enclosure plate (16). Reference to FIGS. 1, 2, 4, and 5 provides an illustration of such width opening adjustment means. More specifically, width adjustment means may be seem to comprised a series of linear aligned adjustment holes (33) bored through top plate (20). Aligned with adjustment holes (33) is slide (25) in which rides pin retainer means (29) with closure setting pin (31) slidably engaged therewith. Closure setting pin (31) is free to move up and down within pin retainer means (29). Pin retainer means (29) slides linearly within slide (25) with the pin aligned along the axis of width adjustment holes (33).

Turning now to FIG. 2, it can be seen that sliding plate (36) has a void (48) cut therein. More particularly, it can be seen in FIG. 2 that sliding plate (36) has pin engagement edge (50) aligned on an oblique angle with the alignment of adjustment holes (33). Thus, by removing closure setting pin (31) from one adjustment hole (33) and sliding pin retainer means (29) in slide (25), closure setting pin (31) may be inserted into any one of the several adjustment holes (33). It can be seen from FIG. 2 that if closure setting pin (31) is set in a hole to be right or near the end of the line of adjustment holes, pin engagement edge (50) will strike pin sooner rather than later. When closure setting pin (31) makes contact with pin engagement edge (50), closure plate (16) can move no further rearward or back, and can only move forward or towards the closure position. Thus, closure setting pin (31) can be set in the furthest adjustment hole to the left as viewed in FIG. 2 for the thickest editions of the newspaper. The series of multiple adjustment holes (33) allows the operator to set an appropriate closure setting width for any size newspaper.

Thus it can be seen that the application discloses a device to retrofit into the cabinets of newspaper vending machine racks to prevent the removal of more than one copy of the newspaper for each vend or door opening of the cabinet. The single vend device consists of a front panel with a T-slot. The arms of the T-slot are normally closed off with a pivoted closure plate. Consumer access to the newspapers is provided through the leg of the T-slot, but the newspaper must be slid through the gap between the closure plate and the front panel. The thickness of the gap is adjustable to selectively allow for the variation in thickness between various editions of the newspaper. The closure plate is spring loaded to be bias to a closed position. Following removal of the paper, the closure of the plate and a locking pin prevents the plate from re-opening. The locking pin is disarmed upon closure of the cabinet door.

Terms such as "left," "right," "up," "down," "bottom," "top," "front," "back," "in," "out," and like are applicable to the embodiments shown and described in conjunction with the drawings. These terms are merely for purposes of description and do not necessarily apply to the position or manner in which the invention may be constructed for use.

Although the invention has been described in connection with the preferred embodiment, it is not intended to limit the invention's particular form set forth, but on the contrary, it is intended to cover such alternatives, modifications, and equivalences that may be included in the spirit and scope of the invention as defined by the appended claims.

I claim:

1. An anti-theft device for a newspaper vending machine having cabinet for substantially enclosing newspapers, an elevator shelf onto which the newspapers are stacked, a manually operated door to provide access to the interior of the cabinet, a means to lockingly engaging the door, and a coin controlled mechanism to engage and disengage the locking means, the anti-theft device comprising:

a front panel with a front and rear surface, for substantially blocking access to the newspaper stack, the front panel having a perimeter thereon dimensioned to removably engage the cabinet of the newspaper vending machine, the front panel with walls defining a "T-shaped" opening, the arms of the opening being of sufficient width to extract a newspaper widthwise therefrom, the leg of the opening being substantially less than the width of a newspaper;

key operative locking means engageable with the perimeter of said front panel to lock said front panel to the walls of the cabinet;

a mounting base with a top and a bottom surface integral with said front panel located above the T-shaped opening of said front panel, said mounting base projecting substantially perpendicular from the rear surface of said front panel;

a closure plate pivotally mounted to the rear surface of said front panel above the T-shaped opening and below said mounting base, said closure plate dimensioned to substantially cover the arms of the T-shaped opening, said closure plate having a flat portion and a bent portion, said closure plate with a leading edge defining the edge between the two portions, said closure plate for moving between a closed position, the closed position with the leading edge substantially flush against the lower edge of the rear surface of the walls defining the arms of the T-shaped opening, the closed position substantially preventing access to the newspapers and an open position, said open position reached by rotation of said closure plate from the closed position until the leading edge of said closure plate is at a position removed from the walls defining the lower edge of the T-shaped opening, the open position defining an access width through which the newspaper is removed from the interior of the cabinet;

a sheet slidably mounted to and flush with said bottom surface of said mounting base, the sheet operatively engaged with the rear surface of the closure plate such that movement of the closure plate towards the open position causes the sheet to slide away from said front panel and across said bottom surface of said mounting base;

means to adjust said access width of the open position of said closure plate, said means comprising walls defining a line of adjustment holes through said mounting base, a pin dimensioned to engage the adjustment holes, pin retainment means, and a channel mounted in alignment with the adjustment holes to guide the pin retainment means, the width adjustment means further comprising an edge of said slidably mounted sheet, the edge in acute angular relationship to the line of adjustment holes for engagement with the pin;

means biasing said closure plate towards the closed position;

means to resettably lock the closure plate in the closed position, said closure plate lock means comprising arm means, pin means, reset means, and walls defining a pair of holes, one of the pair being in said mounting base and the other of the pair being in said sliding sheet, the pairs being in alignment when said closure plate is in the closed position, the arm means coupled to the door of the newspaper cabinet, the arm means to raise the pin out of the aligned holes in said sliding sheet and said mounting plate, when said closure plate is in the closed position, the pin released from its raised position by reset means upon movement of the closure plate from the closed position, thereby allowing the pin to re-engage the holes upon return of said closure plate to the closed position.

* * * * *